US010823541B2

(12) United States Patent
Morsi et al.

(10) Patent No.: US 10,823,541 B2
(45) Date of Patent: Nov. 3, 2020

(54) METHODS AND SYSTEMS FOR BALLISTIC MANUFACTURING OF MICRO/NANO COATINGS AND ARTIFACTS

(71) Applicant: SAN DIEGO STATE UNIVERSITY RESEARCH FOUNDATION, San Diego, CA (US)

(72) Inventors: Khaled Morsi, San Diego, CA (US); Daniel Cavero, San Diego, CA (US); David Hille, San Diego, CA (US); Kyle Stewart, San Diego, CA (US); Sumedha Weerasuriya, San Diego, CA (US)

(73) Assignee: SAN DIEGO STATE UNIVERSITY RESEARCH FOUNDATION, San Diego, CA (US)

( * ) Notice: Subject to any disclaimer, the term of this patent is extended or adjusted under 35 U.S.C. 154(b) by 137 days.

(21) Appl. No.: 16/301,736

(22) PCT Filed: May 17, 2017

(86) PCT No.: PCT/US2017/032988
§ 371 (c)(1),
(2) Date: Nov. 15, 2018

(87) PCT Pub. No.: WO2017/201108
PCT Pub. Date: Nov. 23, 2017

(65) Prior Publication Data

US 2019/0316889 A1 Oct. 17, 2019

Related U.S. Application Data

(60) Provisional application No. 62/337,868, filed on May 18, 2016.

(51) Int. Cl.
*F42B 12/80* (2006.01)
*C23C 4/123* (2016.01)
(Continued)

(52) U.S. Cl.
CPC ..... *F42B 12/80* (2013.01); *C23C 4/08* (2013.01); *C23C 4/123* (2016.01); *F42B 12/78* (2013.01)

(58) Field of Classification Search
CPC ..... C23C 4/123
See application file for complete search history.

(56) References Cited

U.S. PATENT DOCUMENTS 3,016,876 A 1/1962 Sedlacsik, Jr.
4,169,903 A 10/1979 Scholes
(Continued)

OTHER PUBLICATIONS

Morsi, Ballistic Manufacturing, Youtube.com, Sep. 15, 2014 (Sep. 15, 2014), entire document, Retrieved from the Internet: URL:https//www.youtube.com/watch?v=Ci0MPyTusr4, [retrieved on Jul. 11, 2017].

*Primary Examiner* — Tabatha L Penny
(74) *Attorney, Agent, or Firm* — Greer, Burns & Crain, Ltd.; Gregory P. Enhorn

(57) ABSTRACT

Provided herein are systems and methods for applying materials to articles or projectiles in order to coat at least a portion of the projectile. An embodiment of disclosure provides launching the a projectile into a stream of fluid. The fluid may be a molten metal, powder suspension or slip to be later sintered, molten polymer, monomers to be later polymerized or gaseous species that can locally react with the projectile to produce coatings such as oxides, nitrides, carbides, etc. The passage of the projectile through the fluid results in a coating on the projectile.

22 Claims, 8 Drawing Sheets

(51) Int. Cl.
*C23C 4/08* (2016.01)
*F42B 12/78* (2006.01)

(56) References Cited

U.S. PATENT DOCUMENTS

| | | | | |
|---|---|---|---|---|
| 4,528,259 | A * | 7/1985 | Sullivan | G03F 7/00 205/120 |
| 4,657,787 | A | 4/1987 | Singer et al. | |
| 5,194,295 | A | 3/1993 | Iacovangelo | |
| 5,236,746 | A * | 8/1993 | Kapp-Schwoerer | B05C 5/004 427/209 |
| 5,486,657 | A * | 1/1996 | Bell | H05K 1/117 174/250 |
| 6,273,308 | B1 | 8/2001 | Choshi | |
| 6,383,571 | B1 * | 5/2002 | Muhlfriedel | B05C 5/0254 118/407 |
| 6,517,895 | B1 * | 2/2003 | Wolfer | H05K 3/28 427/96.9 |
| 2005/0089673 | A1 | 4/2005 | Fleming et al. | |
| 2005/0150449 | A1 | 7/2005 | Matsunaga et al. | |
| 2010/0055295 | A1 | 3/2010 | Hossainy et al. | |
| 2011/0052819 | A1 | 3/2011 | Ebisawa | |
| 2011/0155432 | A1 * | 6/2011 | Tomonari | B22F 1/02 174/257 |
| 2012/0070928 | A1 | 3/2012 | Kim et al. | |
| 2015/0017325 | A1 | 1/2015 | Dhillon | |

* cited by examiner

METHODS AND SYSTEMS FOR BALLISTIC MANUFACTURING OF MICRO/NANO COATINGS AND ARTIFACTS

CROSS-REFERENCES TO RELATED APPLICATIONS

This application is a National Phase Entry of International App. No. PCT/US2017/032988, entitled "Methods and Systems for Ballistic Manufacturing of Micro/Nano Coatings and Artifacts", filed May 17, 2017 and which claims priority to U.S. Provisional App. No. 62/337,868 entitled "Method, System and Device for Micro/Nano Coatings for Ballistics", filed May 18, 2016, which are both incorporated herein by reference in their entirety.

FIELD

The disclosure relates generally to the field of ultra rapid manufacturing and products produced therefrom.

BACKGROUND

The automation revolution of vehicles, manufacturing equipment and the increasing demand for more interactive personal technology is bound to increase the demand of miniaturized sensors, electronic components and micro-electro-mechanical systems (MEMS). Additive manufacturing of thick and thin films plays a main role in the manufacturing of devices for these technologies. This disclosure presents Ballistic Manufacturing (BM) technology, a novel rapid manufacturing process with potential applications in, and not restricted to, the fields of thin-film, thick-film, MEMS, rapid solidification, micro- and nano-scale stand-alone and integrated artifact/parts manufacturing, additive manufacturing and impact manufacturing.

As the miniaturization of these technologies continues, demand for new materials and processes capable of producing more reliable components grows. In the manufacturing of miniaturized interconnects for instance, the trend is to change aluminum for better conducting copper as the main material, although the current processing techniques have made that difficult. Explosive compaction and rapid solidification processes have provided options for the processing of materials with unique characteristics and features. BM, being a unique processing technique, should be able to combine components of rapid solidification, miniaturized additive manufacturing, and extreme compacting to produce new materials and components.

SUMMARY

There are provided herein systems and methods for applying materials to articles or projectiles in order to coat at least a portion of the projectile. An embodiment of disclosure provides launching a projectile into a stream of fluid. The fluid may be a molten or semi-molten metal or metal composite, powder suspension or slip to be later sintered, molten polymer, monomers to be later polymerized or gaseous species that can locally react with the projectile to produce coatings such as oxides, nitrides, carbides, or provide quenching or heating conditions, etc. The passage of the projectile through the fluid primarily results in a coating on the projectile.

In a first aspect, a method of applying a material to an article is disclosed. The method includes: flowing a stream comprising a material in a first direction; and passing an article through the stream such that the material is applied to at least a portion of the article, wherein the article travels in a second direction at a speed of at least 1 m/s when passing through the flowing material.

In a second aspect, a method of coating an article is disclosed. The method includes: flowing a molten metal in a first direction; passing an article through the flowing molten metal such that the molten metal is applied to at least a portion of the article, wherein the article travels in a second direction at a speed of at least 1 m/s when passing through the flowing molten metal; and solidifying the molten metal to form a coating.

In a third aspect, a system for applying a material to an article is disclosed. The system includes: a reservoir for receiving a material; a conduit fluidly coupled to the reservoir and configured to flow a stream comprising the material in a first direction; a channel configured to provide a path for moving an article in a second direction, wherein the conduit is fluidly coupled to the channel and configured such that the article passes through the stream when moving through the channel; and means for forcing the article through the channel.

BRIEF DESCRIPTION OF THE DRAWINGS

The details of the present disclosure, both as to its structure and operation, may be understood in part by study of the accompanying drawings, in which like reference numerals refer to like parts. The drawings are not necessarily to scale, emphasis instead being placed upon illustrating the principles of the disclosure.

DETAILED DESCRIPTION

Figure 1:
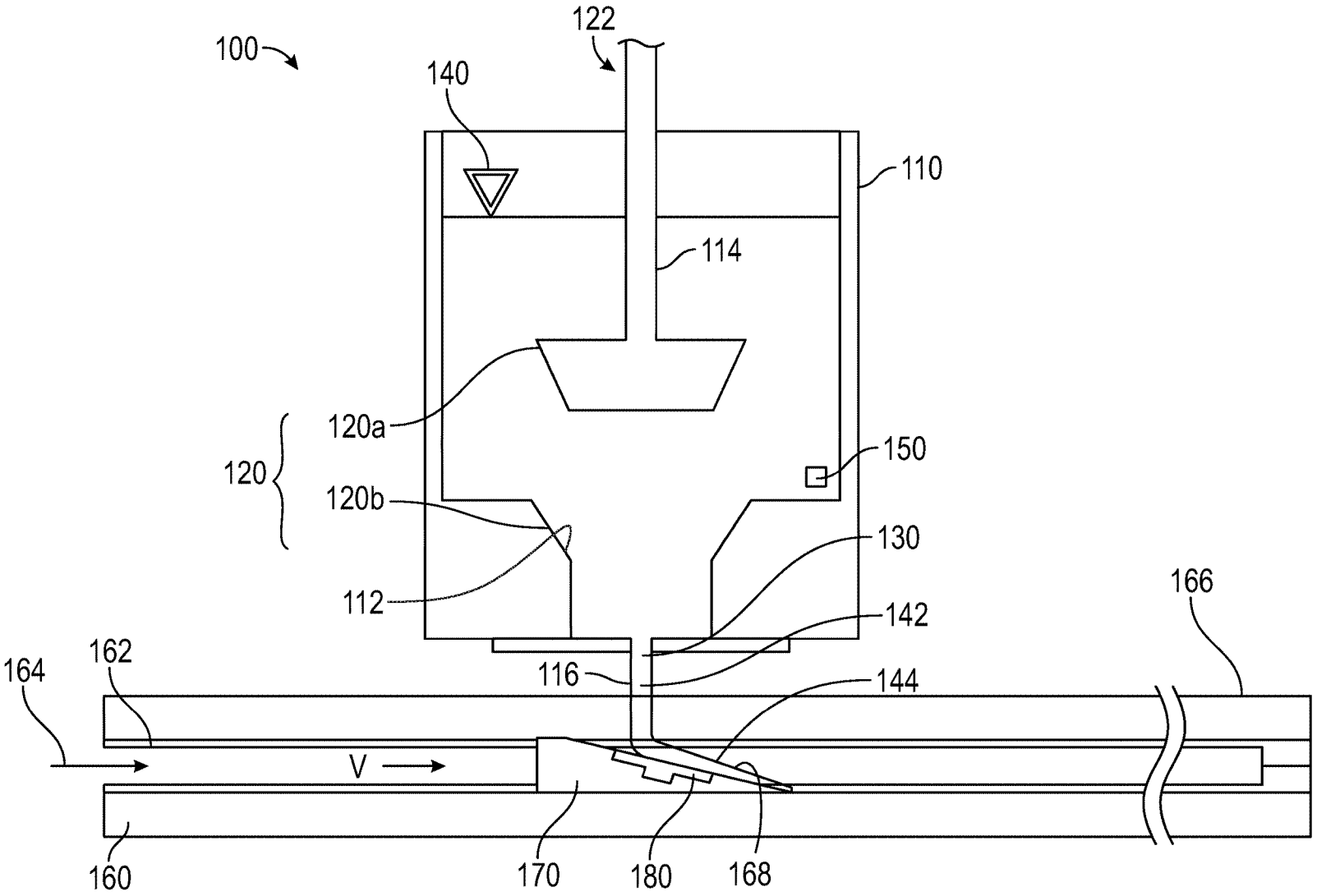
FIG. 1 illustrates a schematic of one example of a ballistic manufacturing system for low temperature lead free solder in accordance with an embodiment of the present disclosure.

The behavior and structure of materials subjected to ultra-rapid (extreme) processing techniques are expected to be different than during conventional processing. Processes such as explosive compaction and rapid solidification have provided options for the processing of materials with unique characteristics and features. Thick films have been defined as those having thicknesses between 2 μm and 100 μm, whereas less than 2 μm they are considered thin films. Processing approaches for films include plasma physical vapor deposition (PVD), flash evaporation, sputtering, electroplating and sol-gel coating. These are complex processes involving high vacuum, chemicals or multiple processing steps. For thick films, screen printing is fundamentally a cost-effective processing technique, involving the use of bonding materials like glass or metallic oxides that usually reduce the conductivity of the film, or an active metal (that can increases the processing cost). Amorphous films have also received a great deal of attention because of their promising applications in micro-electro-mechanical (MEMS) devices and biomedicine.

Within the area of melt processing, planar flow melt spinning (PFMS) is a common and effective process for manufacturing long ribbons of metallic glasses. The process consists of flowing molten metal through a nozzle onto a rotating chilled (with water or other fluids) wheel, to increase the temperature gradients at the casting surface, which allows for undercooling of the material into an amorphous state. Wheel speed has strong effects on both cooling rate and ribbon thickness. Typical speeds investigated in the planar-flow melt spinning process for metals can range from 5 to 80 $ms^{-1}$ with typical thicknesses between 8 μm and a few hundred micrometers depending on material and process conditions. The present disclosure discusses ballistic manufacturing (BM), a novel ultra-rapid processing technique with possibilities in thin, thick, and amorphous film processing, additive manufacturing in addition to micro- and nano-scale standalone or integrated devices As used herein, ballistic manufacturing (BM) is a process that involves the launching of a projectile or carrier, in the form of, or carrying, a substrate or mold (hereafter called a "projectile") at high speed (e.g., below/at or above 343 m/s) into a stream of fluid of certain thickness and width (or radius if cylindrical). The fluid may be a molten metal, powder suspension or slip to be later sintered, molten polymer, monomers to be later polymerized or gaseous species that can locally react with the projectile to produce coatings such as oxides, nitrides, and carbides for example. The passage of the projectile through the fluid leaves a metallic coating on the projectile that can have thicknesses down to the nanoscale.

Using BM, essentially thousands and potentially millions of nano-scale or micro-scale stand-alone or integrated components can be shaped at speeds below, at or above the speed of sound (342 m/s), e.g., instantaneously. Microstructures and nanostructures developed are unique due to the extreme and complex processing conditions applied. Likewise, BM can produce thick and thin films as stand-alone or as coatings ultra-rapidly.

In some embodiments, the projectile is made out of a removable, dissolvable or decomposable material (e.g., ice or wax), which may be separated from the projectile leaving behind microscale and/or nanoscale standalone metallic layers or shapes after removal of the projectile material. Alternatively the projectile may include a permanent mold or substrate on to which the e.g., fluid, is deposited, thereby becoming a coating after solidification, sintering or freezing, or may be lifted off if poor bonding conditions between the coating and substrate/mold prevail. As described in more detail below, the mold may be masked or unmasked, textured or un-textured, containing intruding or extruding features.

In some embodiments, the fluid stream includes any existing molten metal such as aluminum, titanium, nickel, steel, or it can include any intermetallic material such as NiAl, TiAl, $MoSi_2$, and FeAl. Alternatively, the fluid stream may include any metal or intermetallic composite material, such as Ti—TiB, Al—SiC, Al-CNT, $Ni_3Al$-CNT. It may include polymer melt, solution or monomer solution including composites, powder suspension (with or without dispersant, binder and plasticizers)

The fluid stream is usually between 20° C. and 2000° C., although the fluid stream may be between −200° C. and 3000° C. The temperature range may vary depending on the type of fluid. A fluid is defined herein as a molten or semi-molten solid material, powder suspension/slip, liquid, gas, or combination thereof. For example, fluids may include molten or semi-molten metal (including mercury) (e.g., 25-2000° C.), molten or semi-molten intermetallic (e.g., 300-2500° C.), molten or semi-molten metal including composite particles (e.g., 25-2000° C.), a molten or semi-molten intermetallic including composite particles (e.g., 300-2500° C.), a molten or semi-molten polymer with or without composite particle or fibers (e.g., 100-600° C.), powder suspended in a solvent such as water, e.g., ethyl alcohol (e.g., −30-80° C.), powder suspended in solvent with dispersant and/or binder and/or plasticizer (e.g., −30-80° C.), any liquid (e.g., liquid nitrogen) or gas (reacting or non-reacting) (e.g., −210-500° C.). As defined herein, for molten metals, the fluid stream is at a temperature hot enough that at least a portion of the fluid stream is in liquid phase (e.g., molten or semi-molten).

In some embodiments, the fluid stream is moving at a velocity of between about 0 m/s and 600 m/s. The velocity may be achieved by applying a pressure to the fluid stream. For example, a pressure of between about 1 psi and 100 kpsi may be applied to the fluid stream (typically between 14.7 and 1 k psi), as will be explained below with reference to FIG. 1. At 14.7 psi, the fluid may be stationary for example when a heated projectile goes through a reactive gas at atmospheric pressure. Also the fluid stream maybe under vacuum and flow under its own weight.

FIG. 1 shows a schematic of one example of a ballistic manufacturing system 100 for low temperature lead-free solder. BM system 100 includes a crucible 110, a plunger valve 120, a carrier chamber 160, and a carrier 170. As shown, crucible 110 is a reservoir or chamber for receiving a plunger 122 having a shaft 114 and a head 120*a*. Crucible 110 includes an inlet 140 for receiving a molten material and an outlet or slit 130 for the molten material to exit out of crucible 110.

Crucible 110 also includes a funnel-shaped surface 112 that makes up the female portion 120*b* of plunger valve 120. Plunger head 120*a* makes up the male portion of the plunger valve 120. Crucible 110 may also include a thermocouple 150 and/or any other electronics for monitoring the process conditions of BM system 100.

In communication with slit 130 is a channel 116 that connects the crucible 110 with carrier chamber 160. Carrier chamber 160 includes one or more guide rails 162, an inlet 164 for receiving carrier 170, and a capped end 166.

In some embodiments, the inlet 164 may be used as a pressure input, such that pressure is applied to carrier 170, making it move toward and receive molten material 144 from channel 116.

As shown, carrier 170 includes a wax substrate 180. Wax substrate 180 and carrier 170 are exposed to the molten material 142 as it exits crucible 110 through slit and into channel 116. The molten material 142 received on carrier 170 is depicted as deposited material 144.

In order to use BM system 100, the crucible 110 is filled with a coating material via e.g., inlet 140. The material is brought to a desired melt temperature with the plunger valve 120 closed (e.g., male portion 120*a* in contact with female portion 120*b*) such that the molten material is blocked from flowing out of the crucible 110. The material inserted into crucible 110 can be introduced as solid or liquid, and then heated to a desired temperature. The temperature of the molten coating material may be monitored by thermocouple 150 in crucible 110.

To initiate molten material flow, the plunger 122 is lifted e.g., via lifting shaft 114, disengaging the plunger valve 120 to allow the coating material to flow down and out slit 130, forming a molten curtain of molten material 142. The molten material 142 projects downwards from the bottom of the crucible 110 through channel 116 and into a coating zone 168 of carrier chamber 160. As shown, BM system 100 uses slit 130 to govern the molten material's 142 geometry, but other systems could utilize an atomized curtain or other methods for forming the curtain/coating supply.

Once the molten curtain/stream has formed and stabilized in the coating zone 168, the carrier 170 and/or substrate 180 is launched down the guide rail 162 by accelerating pressure, bringing the carrier 170 into contact with the molten curtain. The carrier 170 and/or substrate 180 goes through the molten metal stream/curtain, leaving a deposited coating 144 on the projectile (e.g., carrier 170 and/or substrate 180).

Once the projectile leaves the curtain, it may be decelerated to allow for processing. BM system 100 uses compressive air braking to accomplish this deceleration, allowing the projectile to slow down to a stop without applying any physical pressure that could compromise the integrity of the coating on the projectile. Other methods for accomplishing deceleration may alternatively be used and are within the scope of the present teachings.

Still referring to FIG. 1, multiple fluid streams (of same or different materials) resulting in sequential layering of the projectile may be used, thus enabling additive manufacturing type processing with reactive or nonreactive layers. Alternately the stream or environment could be a medium that allows quenching or heating of the substrate/projectile. The layers can be macro, micro- or nano-scale. This layering is discussed in further detail below.

In some embodiments, the fluid stream may include particles (e.g., nano, micro, macro) to produce micro/nano-composites. For example, molten aluminum mixed with SiC particles, when applied will solidify as Al—SiC composite.

In some embodiments, the fluid stream includes a slip (e.g., a solvent in which are suspended micro sized or nanosized particle (ceramic, polymer, metallic or intermetallic) to be used as is or later processed to produce consolidated features). Suitable slips include alumina nano powder suspended in water to which is added a dispersant and/or binder and/or plasticizer (e.g. polyethylene glycol, polyvinyl alcohol).

In some embodiments, the fluid stream includes a gas, or gas emitting entities (including particles) to produce porous layers or artifacts. For example particles of $TiH_2$ (foaming agents) suspended in aluminum melt, so that before/during or after coating the $TiH_2$ dissociates giving off hydrogen, which can generate porosity in the coating. Alternatively the substrate/mold or substrate may contain the foaming agent or dissolvable micro or nanofeatures, which leave behind porosity after dissolution or reaction (if reacts with the coatings).

In some embodiments, the environment includes a vacuum of a gas that reacts or does not react with the any of the materials during the process. For example an oxidizing environment such as air in which a heated substrate such as aluminum can go through atmosphere and react to form a nano-oxide layer. Otherwise the projectile/mold/substrate can accelerate in air/vacuum/inert gas for reactive gas with or without the fluid stream.

In some embodiments, the fluid stream may include various shapes and dimensions. For example, the molten stream may take the shape of solid or hollow cylinder, or a square or rectangular cross-section and/or have exemplary dimensions of 10 cm length, 5 mm thickness and 30 mm width. It should be appreciated that many other shapes and/or dimensions are contemplated within the scope of this disclosure.

In some embodiments, the fluid stream is electrically charged. In other embodiments, the fluid stream is not electrically charged. Suitable charges may be in the range of approximately 0 to 100 kV. Electrically charging may be achieved via a suitable power supply.

In some embodiments, the fluid stream is magnetic. In other embodiments, the molten stream is not magnetic. A combination of magnetic fluid with a suitable magnetic substrate or projectile may provide better coverage on the projectile by fluid attraction, e.g., in intricately small and complex features.

In some embodiments, the fluid stream is generated under pressure. For example, suitable pressures include approximately 1 psi to 100 kpsi (typically between 14.7 and 1 kpsi). The pressures may be introduced to the molten stream via gas or piston or other approaches. In other embodiments, the fluid stream is not generated under pressure. For example the projectile is accelerated through the guide chamber filled with a fluid.

While thus far referred to as a fluid stream, in some embodiments, the stream is an atomized spray instead of molten material. For example, molten stream is met by inert gas jets, which break it up into droplets that coat and solidify on the substrate/mold/projectile. In some embodiments, the stream is spray dried powder.

Figure 2:
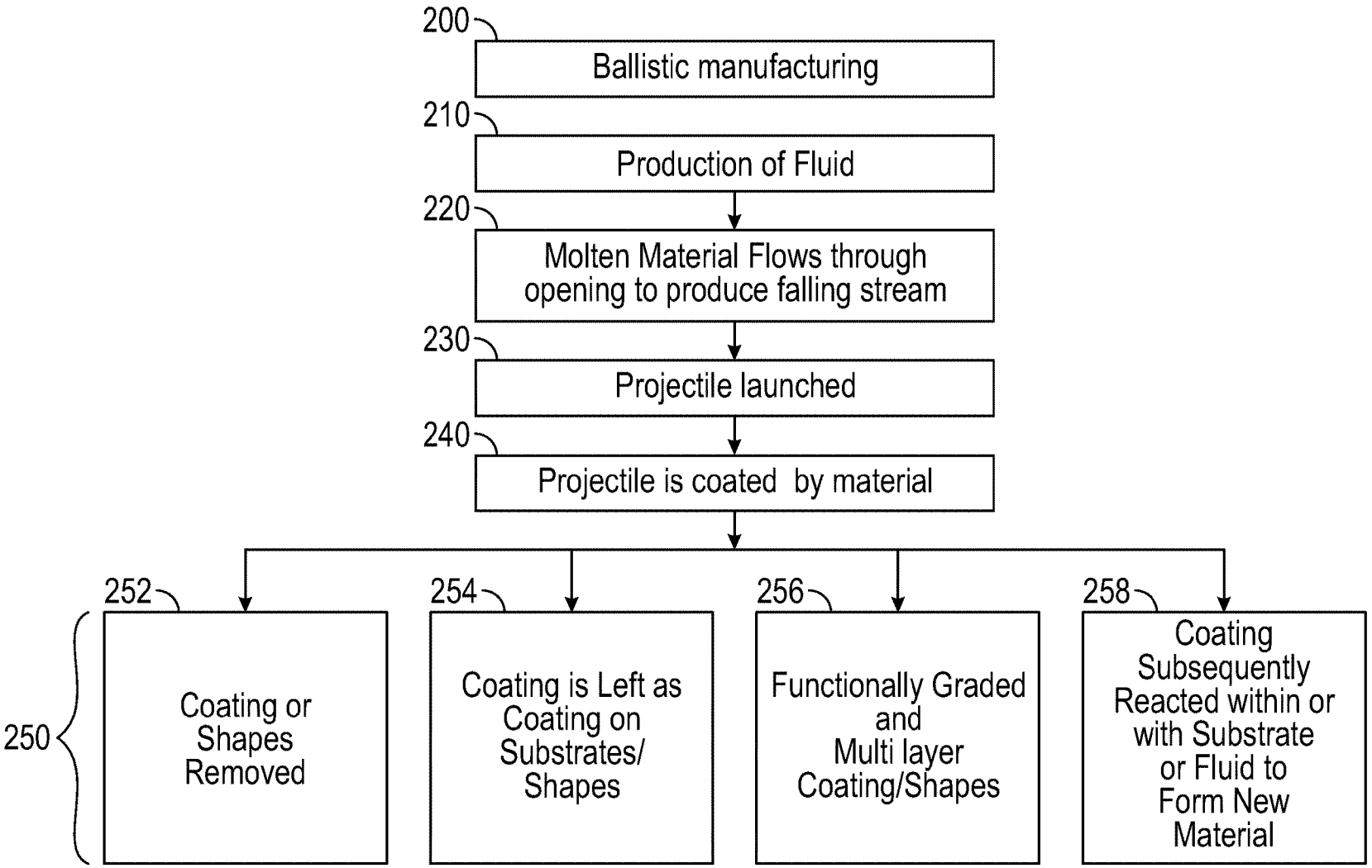
FIG. 2 illustrates an example flow chart of a ballistic manufacturing process in accordance with an embodiment of the disclosure.
Figure 3D:
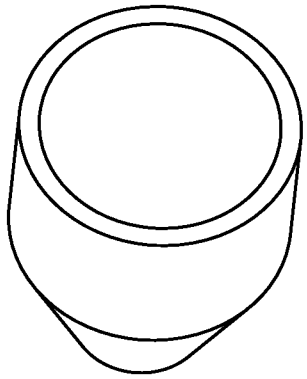
FIG. 3*d* illustrates an example final component after projectile disintegration in accordance with an embodiment of the disclosure.
Figure 3C:
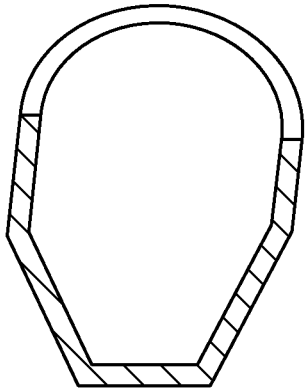
FIG. 3*c* illustrates an example cross-section of coated wax projectile in accordance with an embodiment of the disclosure.
Figure 3B:
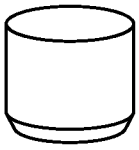
FIG. 3*b* illustrates an example model of an impinging projectile in accordance with an embodiment of the disclosure.
Figure 3A:
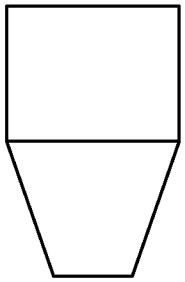
FIG. 3*a* illustrates an example model of an approaching projectile with wax substrate in accordance with an embodiment of the disclosure.

FIG. 2 shows an example flow chart of a ballistic manufacturing process 200. In a first step 210, the material is melted to produce a fluid. In some embodiments, the material is exposed to temperatures between about −50° C. to about 4,000° C. In a second step 220, the molten material flows through an opening in the crucible to produce a falling fluid stream. In some embodiments, the fluid stream cross-section shape varies such as cylindrical, square or rectangular and may be produced by the shape of the opening in the crucible. For example, the thickness or radius may be in the range of about 1 micron to 12 inches, and the width may be in the range of about 1 micron to 100 feet.

In a third step 230, the projectile is launched into the molten stream. The projectile may be launched at speeds, for example, ranging from about 0.01 m/s to 1000 m/s (typically e.g., 1-400 m/s). Also the projectile may enter the molten fluid stream at an incidence angle in the range of about −180° to about +180°.

In a fourth step 240, the fluid material, such as molten metal, coats the projectile. In a fifth step 250, the resultant product is produced. As shown, various resultant products may include: stand alone products where the coating or shapes are removed from the projectile 252; integral products where the coating is left on the projectile 254; functionally graded and/or multilayer coatings or shapes 256; and coatings subsequently reacted within or with the projectile or fluid to form a new material 258.

In some embodiments, if molten metal is allowed to flow as a vertical stream (e.g., as is the case in the process of atomization), the molten metal stream can be met by ultra-rapidly traveling projectiles of controlled small shape and size. These projectiles may be of two types.

The first type of projectile/mold or substrate may be made of a material that would survive the impact with the molten metal and provide conditions for its subsequent coating with the metal. Hence ultra-rapid micro- and nano-coating can be enabled. Depending on surface conditions, these coatings may be removed or left as is. Depending on the projectile/substrate or mold thermal properties (e.g., thermal conductivity) enhanced rapid cooling or slower cooling maybe achieved.

The second type of projectile may involve the use of a disintegrable projectile. In this case, the projectile would initially have the shape and cavities to be coated or filled respectively by metal from the molten metal stream. However following the ultra-rapid solidification of the metal, the initial disintegrable projectile can then be either melted away, burned off or in other instances the projectile would exothermically react with the molten metal (or simply inter-diffuse) and form a totally new compound or alloy.

Examples of materials that can be used for the disintegrable projectile are, but not limited to, ice, wax, polymer, or metal. For example, the molten metal rapidly coats and rapidly solidifies (e.g., due to the high convective heat loss enabled by the high speed projectile) on the wax and then the wax is later dissolved leaving a micro-scale product of controlled shape and size. This would turn powder atomization from a process that could produce powders of shapes ranging from spherical to irregular, into a process that can produce powder of precise meaningful micro-scale shapes. FIGS. 1 and 2 show a models of the disclosed process.

FIG. 3 shows models of (a) approaching wax projectile (b) impinging projectile (c) cross-section of coated wax projectile and (d) final component after projectile disintegration. The projectile speeds can be sub-sonic, and supersonic. As described below, devices may be in place to stop the projectile without damaging the artifact.

Another alternative for very small molds and hence artifacts, is that molds can be placed on "carrier" projectiles that allow the successful entrance and exit of the molten metal stream, e.g., maintains an appropriate kinetic energy. Here dense material such as tungsten (e.g. density 19.3 $g/cm^3$) may be an example of projectiles for small projectiles.

As can be appreciated, a variety of shapes of projectiles and surface features on the substrates/molds may be produced using BM. The various product shapes that can result include stand-alone 0D, 1D, 2D, 3D microscale and nanoscale structures. These shapes may be accomplished producing a mold or substrate that contains numerous micro and/or nanofeatures as templates. Such features can be simple or complex (e.g., dots, lines, 2D, 3D shapes, extruding or intruding (e.g., male or female)). Areas of the substrate can be masked or treated prior to processing, such that standalone microscale and nanoscale parts can be produced on the unmasked or untreated areas once released.

In some embodiments, the projectile pulls any extended/long substrate or mold, so that large areas may be coated. In such embodiments, the projectile may be rotating or non-rotating.

In some embodiments, the mold is masked or unmasked, textured or un-textured, containing intruding or extruding features. For example, by masking or treating areas of the substrate/mold or projectile so that fluid does not adhere to it, this leaves other attached or unattached micro and nano shapes on which the fluid stream may be deposited and later released if need be resulting in stand-alone shapes or devices such as microgears or nanogears. Extruding features on the substrate can be coated to increase surface area, for surface area dependent applications such as solar energy and batteries etc. For example, in some embodiments, mask may be used to produce patterns (e.g., macro/micro/nano) of various shapes.

Alternatively, under certain conditions textured surfaces may be produced without the use of textured projectile/mold/substrate. This is due to the complex coating interactions with substrate and atmosphere, thermal properties of substrate/mold and speed of projectile. An example is seen in FIG. 10, showing a side view of film (FIG. 10*a* at lower resolution and FIG. 10*b* at higher resolution) with extruding texture and top view (FIG. 10*c* at lower resolution and FIG. 10*d* at higher resolution) with microstructure, in cases hierarchal structures have been observed.

Figure 4:
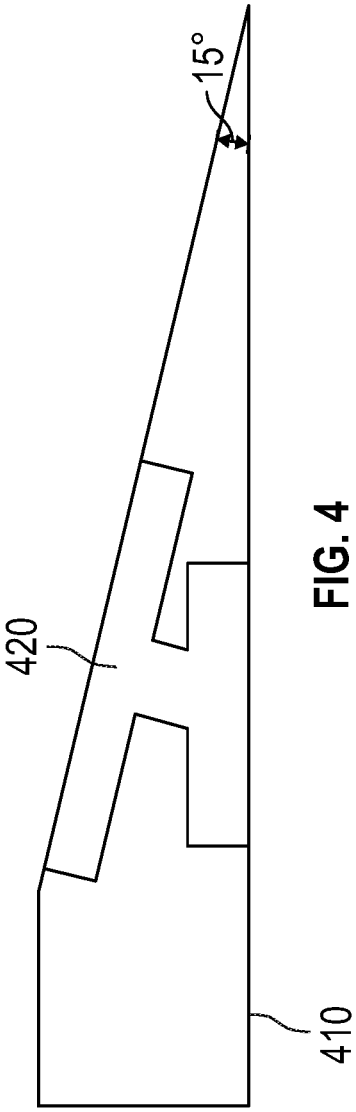
FIG. 4 illustrates a side view of an example carrier with wax substrate inclined at 15° in accordance with an embodiment of the disclosure.
Figure 5:
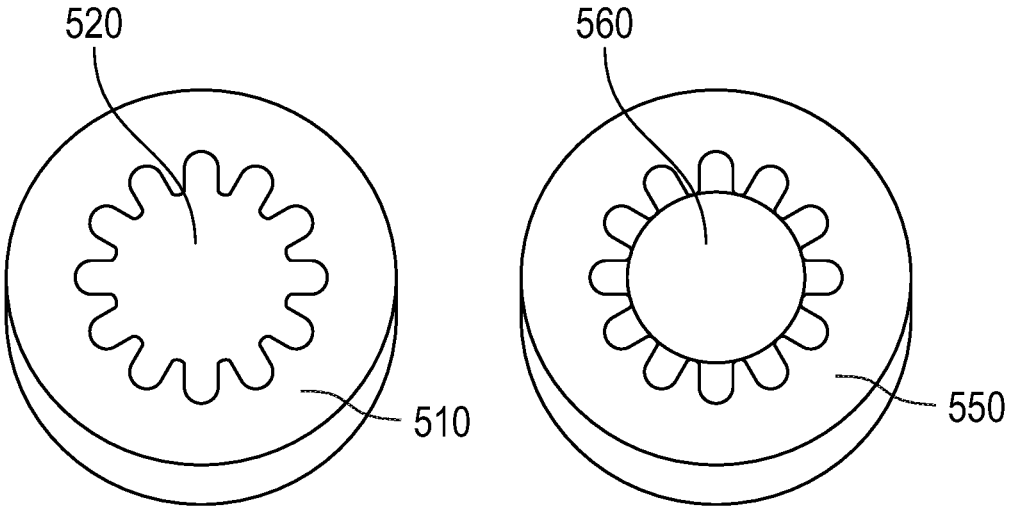
FIG. 5 illustrates an example mold or substrate with surface depressions of shapes than can be filled during deposition in accordance with an embodiment of the disclosure.

FIG. 4 shows a side view of carrier 410 with wax substrate 420 inclined at 15° and FIG. 5 shows an example mold or substrate 510, 550 with surface depressions of shapes than can be filled during deposition. In FIG. 4, the resultant projectile would take the shape of wax substrate 420. In FIG. 5, the resultant projectile, mold or substrate would take the shape of a single or multiple macro, micro or nano gears 520, 560, depending on if the substrate has multiple depressions with the gear shapes at macro-micro and nano-scales.

Figure 6:
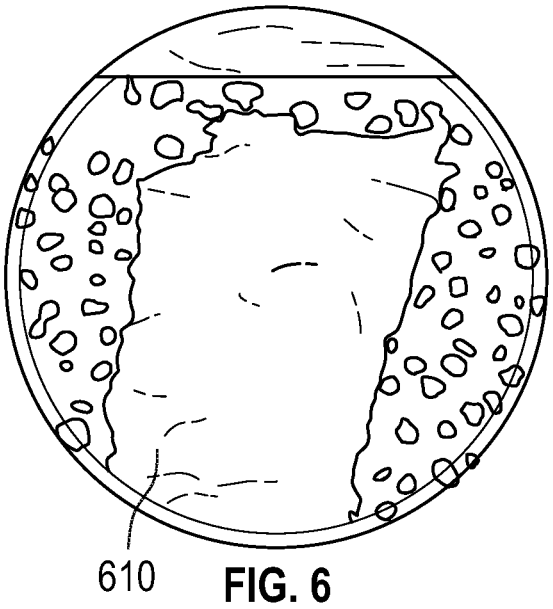
FIG. 6 illustrates an example continuous thick film of Sn-0.7Cu produced in accordance with an embodiment of the disclosure.

FIG. 6 shows a continuous thick film 610 of Sn-0.7Cu. As can be appreciated, such films were produced at projectile speeds as high as 36 m/s in the present example. In some embodiments, increasing the projectile speed to extreme levels such as below and above the speed of sound in air (e.g., 343 m/s) could result in nano-thick coating being produced virtually instantaneously.

In some embodiments, the projectile or substrate includes an integrated surface coating. In such embodiments, continuous or isolated areas of components and shapes (e.g., using masking/treatment) can be coated rapidly. For example, below, at or above the speed of sound in air, e.g., 343 m/s. These surface coatings are an integral part of the component to be coated. Multiple coatings may also be applied by having a sequence of fluid streams through which the projectile/substrate travels.

In some embodiments, the projectile or substrate includes a surface reactive coating. In such embodiments, continuous or isolated areas and shapes using masking followed by a reaction of the substrate to produce a new material product. In some embodiments, a reaction on the substrate may be achieved with a gaseous and/or liquid phase to produce a new material product. Examples of surface reactive coating include deposition of multiple layers in sequence during ballistic manufacturing such that a first metal is deposited followed by second metal (e.g., using 2 or more molten metal streams in succession).

In some embodiments, the projectile or substrate includes functionally graded composites and multi-layered products. In such embodiments, the projectile goes through multiple consecutive melt streams to deposit metal composite multilayers of varying reinforcement volume fraction/and or particle sizes (e.g., functionally graded). Similarly different materials can be deposited to produce multi-layered coatings or multi-layered stand alone shapes. Alternatively, the graded composites or multi-layered products may further subsequently be reacted to produce new coating materials (e.g., surface reactive coatings). Alternatively powders suspended in a fluid is used to make the fluid stream and coat the substrate while another powder suspension follows, and so on to produce composite nanolayered composites or functionally graded coatings following sintering or high temperature consolidation.

In some embodiments, the layered features may be standalone or coatings on other materials (e.g., reactive or non-reactive). For example, a nickel substrate material coated with molten aluminum followed by heat treatment either by electrically heating the projectile or subsequent to convert aluminum and the nearest nickel into nickel aluminide coatings by reactive synthesis. In some embodiments, the layers are made out of multifunctional materials or functionally graded, as provided above.

In some embodiments, the projectile and/or mold may include a textured negative or positive mold or flat surface or curved surface. For example, for the production of nano gears or springs.

In some embodiments, the projectile and/or mold may include artifacts to be coated. For example, the projectile could be the intended final component that needs to be coated. Or it could simply act as a carrier that carries the mold or substrate that may or may not include pre-machined or imprinted or formed nano or micro features, which the fluid subsequently coats.

In some embodiments, the projectile may be guided. In other embodiments, the projective is not guided. As an example, a projectile may be guided by rails to control the trajectory and stability of the projectile. Alternatively the projectile may be guided by magnetic forces without physical contact. In another example the projectile may achieve flight in air, vacuum or other gasses or liquids.

In some embodiments, the projectile is heated. Suitable temperatures are in the range of approximately 50° C. to 2000° C., depending on various factors such as the composition of the projective, the composition of the fluid stream, etc. In alternative embodiments, the projectile is not heated. For example the projectile would be used at room temperature or cooled to cryogenic temperatures, e.g., −260° C.

In some embodiments, the projectile is electrically charged. In other embodiments, the projectile is not electrically charged. Suitable charges may be in the range of approximately 0 kV to 100 kV. Electrically charging may be achieved via a suitable power supply.

In some embodiments, the projectile is magnetic. In other embodiments, the projectile is not magnetic. Suitable magnetic strength may be in the range of approximately $10^{-18}$ Tesla to 100 Tesla. Magnetically charging may be achieved via a suitable magneto or generator.

In some embodiments, the projectile may include multiple sub projectiles (and/or molds) with dimensions that may be controlled laterally and length-wise. For example, the projectile may itself project other smaller projectiles at yet higher speeds than the primary projectile. In some embodiments, the substrate or mold and carrier (which carries the mold or substrate) may be separate pieces or components. Alternatively, the substrate or mold and carrier may be a single piece or integral components.

In some embodiments, the projectile may have spin motion on one or more axes. For example, axial rotation, such as the flight of a bullet in air.

In some embodiments, the projectile, or mold/substrate may be disintegrable, dissolvable, meltable, etc. In such embodiments, the projectile is generally constructed from a wax type of material. In other embodiments, the projectile is generally constructed from a polymeric type of material, such that the projectile is a polymer that can later be burned off or dissolved.

In some embodiments, the projectile, material and/or mold surface may be partially or fully bondable (through controlling surface chemistry for example) to the fluid stream. In other embodiments, the projectile, material and/or mold surface is not bondable to the fluid stream (e.g., by controlling again surface chemistry of substrate/mold or projectile or other masking techniques)

In some embodiments, the projectile may be accelerated or decelerated when introduced into or within the fluid stream. The acceleration/deceleration may be achieved by pushing or pulling using, for example: gas pressure, electromagnetic forces, ballistically/explosively/reactively, and/or mechanically. For example speed may be halved or doubled, or projectile speed variation controlled by varying e.g., electromagnetic parameters.

In some embodiments, the projectile may also be texturized in the fluid stream. By charging the stream and projectile/substrate/mold atomized particles may preferentially be deposited on certain regions by design.

EXAMPLE

A tin-copper (Sn-0.7Cu) alloy was used as a model material due to its low melting point, however obviously results are applicable to many other material systems. Although the present disclosure investigates processing velocities up to 36.1 m/s, higher ballistic velocities even above the speed of sound are possible with Ballistic Manufacturing. The present example provides an initial insight into the capabilities of BM and the developed microstructures in the lower velocity regime.

Materials and Methods

The experimental equipment for this investigation was all custom built at San Diego State University's Advanced Materials Processing Lab (AMPL). The casting material used was a low melting point Kester K100LD lead free solder alloy (Sn-0.7Cu), USA.

A schematic of the BM process and setup is shown in FIG. 1. An aluminum carrier (projectile) holds a flat wax substrate. The wax is machinable and purchased from MachinableWax.com, Inc., USA. The wax was initially melted, and cast into the carriers using a glass microscope slide at the bottom to ensure a flat casting surface with very good surface finish. The projectile/substrate was designed having an inclined surface of 15°.

For each experiment, the solid Sn-0.7Cu solder alloy was melted in a stainless steel crucible heated by a tape heater to a temperature of 375° C. (648 K) prior to casting. A plunger valve at the bottom of the crucible is opened after the desired temperature is reached. The molten solder was then allowed to flow through a rectangular slit 0.9 mm in thickness and 31.75 mm in width and a curtain of molten alloy was formed as seen in FIG. 1. The carrier/substrate were then accelerated pneumatically inside the barrel, using air pressures of 200, 700, 1000, and 1500 psi. The end of the barrel was capped allowing projectile deceleration through backpressure buildup after the projectile had gone through the molten metal stream.

Casting velocity (e.g. projectile velocity at point of melt contact) was determined by analyzing the video frames from a high-speed camera (Photron SA.1 high speed camera, USA, capability up to 180,000 frames per second (fps)). For the 200 psi and 700 psi velocity measurement experiments, the camera was set to record at 5400 fps and for the higher pressures of 1000 psi and 1500 psi the camera was set to record at 40000 fps. The actual casting experiments were also recorded using the high-speed camera. This time, 90000 fps were used and the video was shot at an angle of approximately 60° to the projectile path in order to capture rapid events.

A Cryostat Microm HM550 microtome was used to cross-section the films attached to the wax substrate. Microstructural characterization and thickness were conducted using a Quanta 400 field emission scanning electron microscope (FESEM), USA. The average cell size was measured using the line intercept method. Images were taken from the front, middle, and back of each film, and an average calculated.

Results and Discussion

Figure 7A:
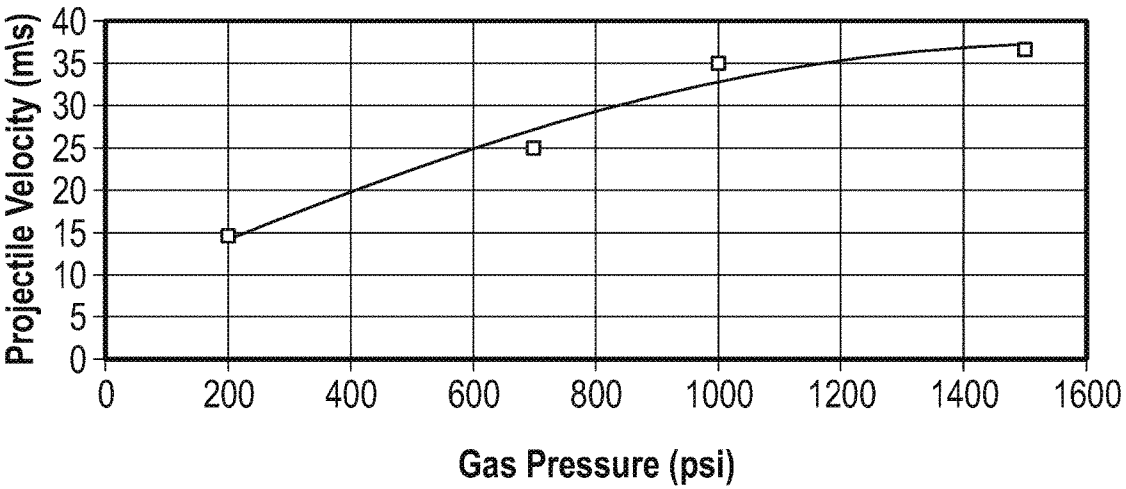
FIG. 7*a* illustrates an example relationship between accelerating air pressure and casting velocity in accordance with an embodiment of the disclosure.

FIG. 7*a* shows the relationship between accelerating air pressure and casting velocity (e.g. projectile velocity at the point of casting). FIG. 7*a* shows limited gain in velocity at the higher pressures. Although factors such as projectile design and weight optimization may help to exceed the maximum velocity of 36.1 m/s, other means of acceleration and deceleration are required to achieve significantly higher processing velocities (even above the speed of sound).

Although the crucible was maintained at a temperature of 375° C. (648 K) prior to casting, pre-calibration tests have shown that the melt exits the crucible at an average temperature of 352.1° C. (625.1K). (e.g. ~125° C. (398 K) above the material's melting point of 227° C. (500K), at which the viscosity of the Sn-0.7Cu melt has been reported to be still low with a value of ~1.9 mPa·s.

Figure 7B:
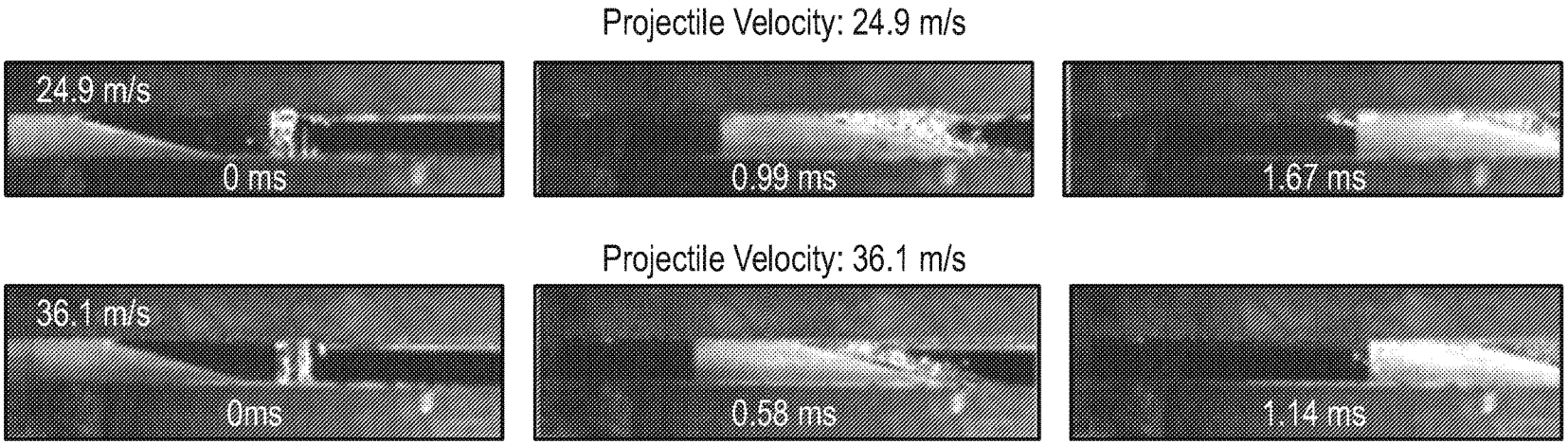
FIG. 7*b* illustrates snapshots of high-speed videos taken during BM at 24.9 m/s and 36.1 m/s in accordance with an embodiment of the disclosure.
Figure 8A:
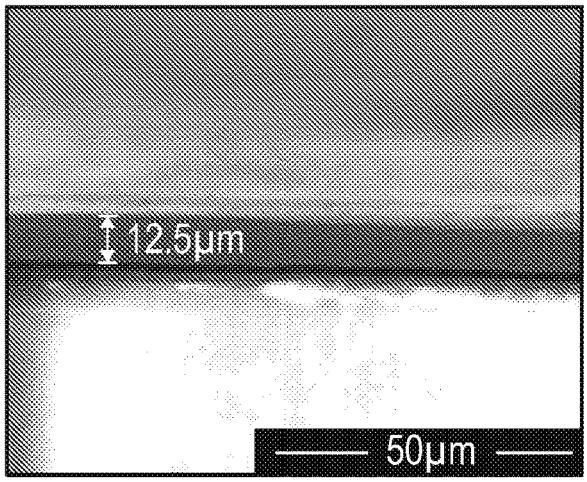
FIG. 8*a* illustrates a SEM cross-section of a thick film in accordance with an embodiment of the disclosure.
Figure 8B:
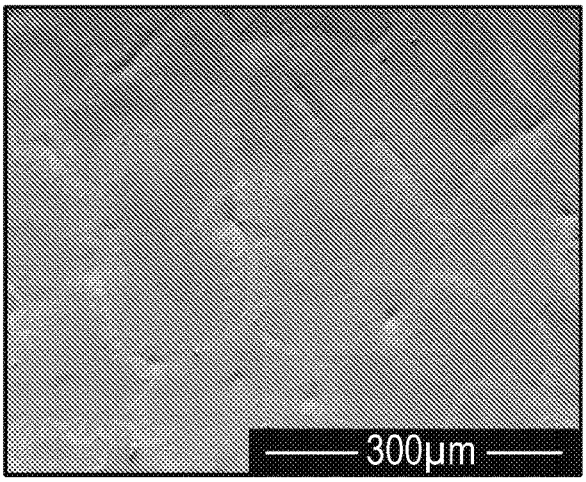
FIG. 8*b* illustrates a low magnification SEM micrograph showing multiple 2D Sn cells surrounded by a eutectic phase in accordance with an embodiment of the disclosure.
Figure 8C:
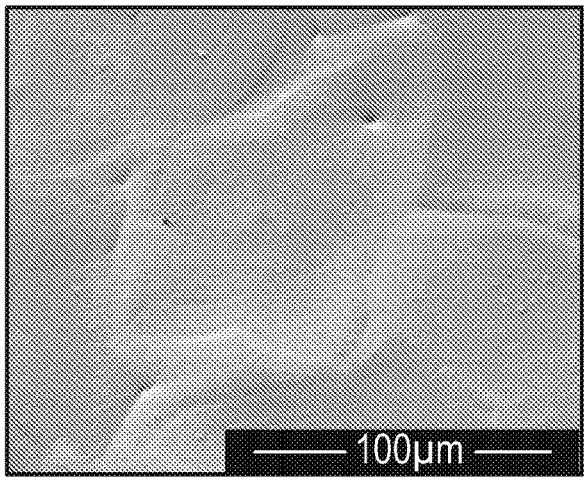
FIG. 8*c* illustrates a higher magnification image showing possible initiation of secondary arms in accordance with an embodiment of the disclosure.
Figure 8D:
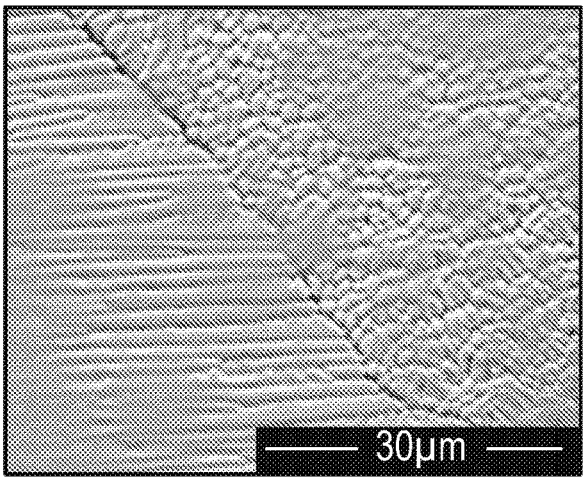
FIG. 8*d* illustrates a higher magnification electron micrograph of the interface between two cells showing different orientation of the eutectic phase in accordance with an embodiment of the disclosure.

The high-speed videos (FIG. 7*b*) were helpful in revealing the nature of the thick film casting process, which was fairly chaotic. As can be seen, the casting/coating process is complete within a few milliseconds at the investigated projectile speeds. The initial contact between the projectile/wax surface and the molten Sn-0.7Cu stream initiates melt splashing, which is somewhat reduced at the slowest investigated velocity of 14.7 m/s. Additionally, at the highest speeds of 34.6 m/s and 36.1 m/s, the melt droplets formed from the initial projectile/substrate-melt contact typically re-contact the back substrate surface. Substrates had good coverage of thick film. Although most films appeared continuous, pockets of uncoated regions were still observed (possibly due to un-optimized substrate surface condition).

FIG. 8 shows an example for films processed at 14.7 m/s. These structures are characterized by primary Sn cells surrounded by eutectic lamellar microstructures (a microstructure typical of this off-eutectic alloy). Some interesting microstructural features were however evident. First the microstructures generated in our study are 2-D in nature with aspect ratios of at least ~9-13:1. It is also clear that there is no preferred orientation for the eutectic phase, as can be seen in FIG. 8*d*, showing the interface between two eutectic regions of different orientation.

Figure 9A:
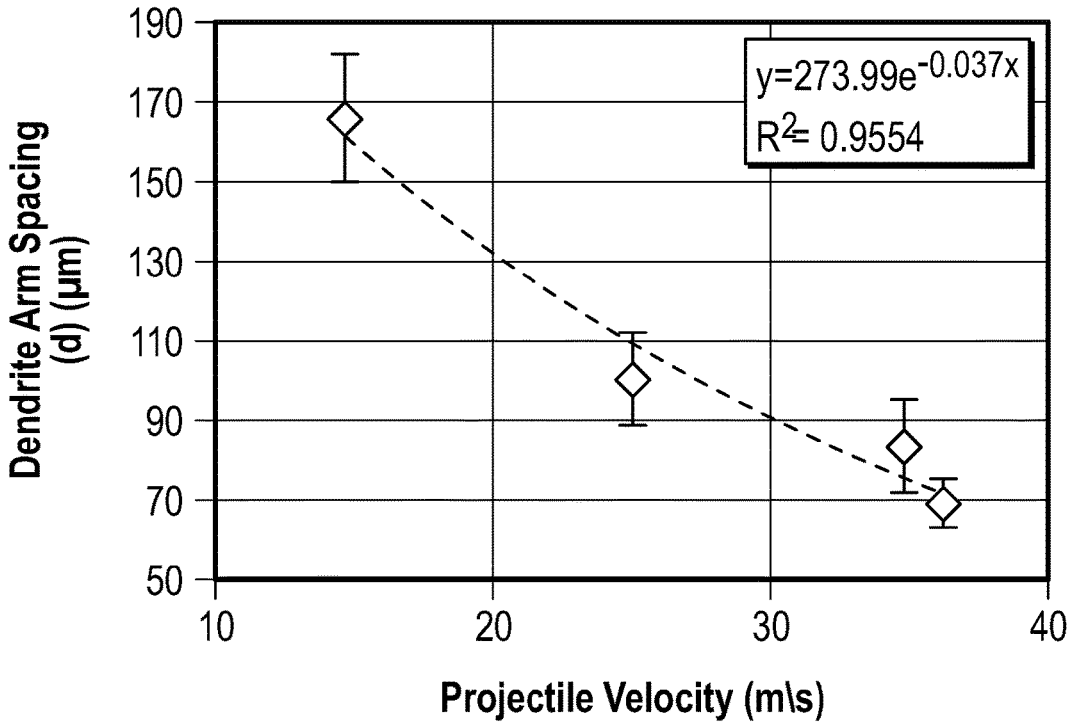
FIG. 9*a* illustrates average primary dendrite spacing in accordance with an embodiment of the disclosure.
Figure 9B:
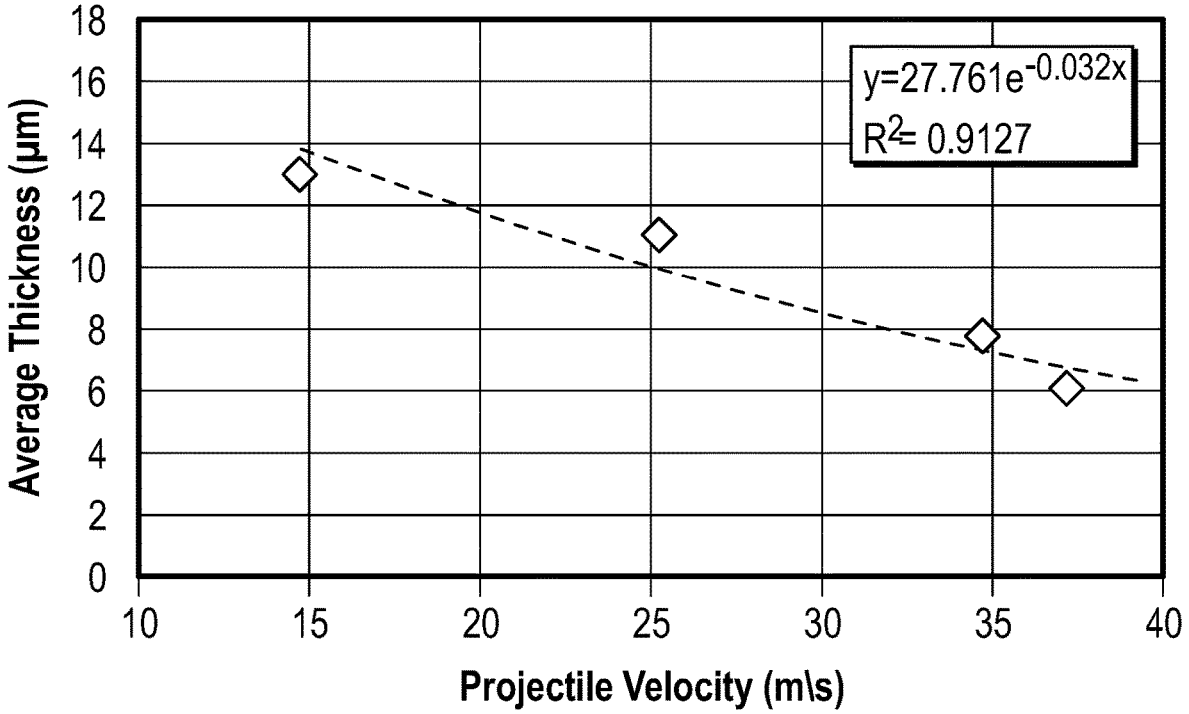
FIG. 9*b* illustrates average film thickness as functions of the casting velocity in accordance with an embodiment of the disclosure.
Figure 10A:
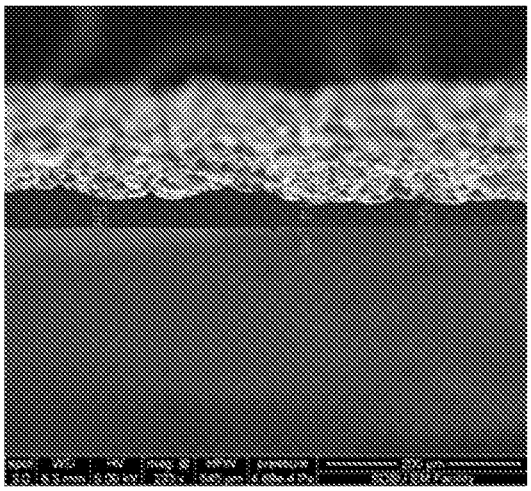
FIG. 10*a* illustrates a side view low magnification SEM micrograph showing textured surface without using textured substrate in accordance with an embodiment of the disclosure.
Figure 10B:
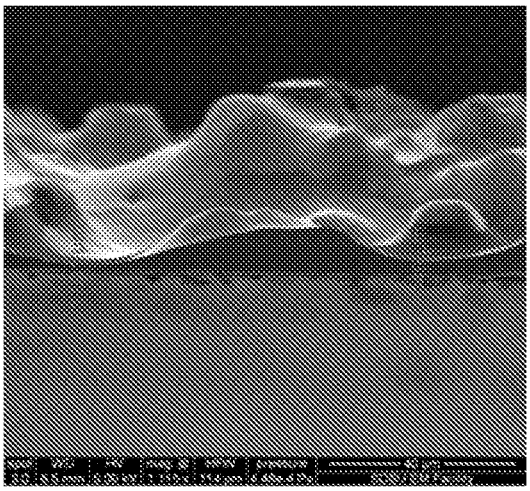
FIG. 10*b* illustrates a side view high magnification SEM micrograph showing textured surface without using textured substrate in accordance with an embodiment of the disclosure.
Figure 10C:
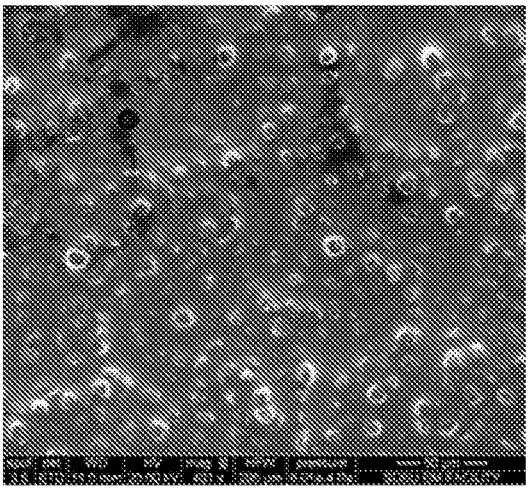
FIG. 10*c* illustrates a top view low magnification SEM micrograph showing textured surface without using textured substrate in accordance with an embodiment of the disclosure.
Figure 10D:
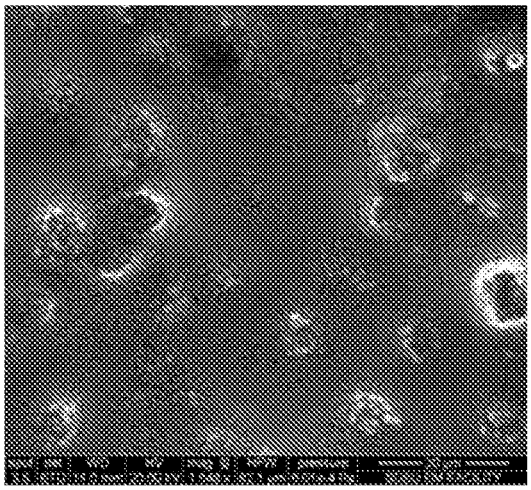
FIG. 10*d* illustrates a top view high magnification SEM micrograph showing textured surface without using textured substrate in accordance with an embodiment of the disclosure.

The average primary dendrite spacing (d) was found to significantly decrease with an increase in projectile velocity (FIG. 9*a*), reaching around 70 μm at the highest velocity investigated. As can be seen in FIG. 9*b* as the projectile velocity is increased, the thickness of the films also decreases (a similar trend to that observed in PFMS), such that an average thickness of 6.06 μm was obtained at the highest projectile velocity of 36.1 m/s. Eutectic cellular structures were observed in all of the processed films. The relation between solidification kinetics and resulting microstructure of Sn-0.7Cu has been studied by Ventura et al., Acta Mater. 59, 1651 (2011) who found that when Sn-0.7Cu is directionally solidified, it forms aligned off-eutectic cellular or dendritic structures, with a primary β-Sn phase surrounded by eutectic phase β-Sn+$Cu_6Sn_5$. The dendrite arm spacing is known to decrease with the increase in solidification rate. Flemings, Metall. Trans. 5, 2121 (1974) arrived at the following simple relation:

$$d = a t_f^n \tag{1}$$

Where d is the spacing between primary dendrites, a is an alloy-specific constant, $t_f$ is the local solidification time and n is close to ½ for primary dendrites. Solidification time $t_f$ can be expressed as, $$t_f = \frac{\Delta T}{Q} \tag{2}$$

Where ΔT is the solidus-liquidus temperature range and Q is the cooling rate. In order to compare the relative cooling rates for the Sn-0.7Cu alloy processed at our different speeds, Eq. (2) can be substituted into Eq. (1) yielding:

$$d = a\left(\frac{\Delta T}{Q}\right)^n \tag{3}$$

Taking the dendrite arm spacing of the specimen shot at the slowest velocity, $d_s$, as a reference with $Q_s$ being its corresponding cooling rate, the ratio of $d_s$ to the other dendrite arm spacings is:

$$\left(\frac{d_s}{d}\right)^{1/n} = \frac{Q}{Q_s} \quad (4)$$

This same relationship was applied by Byrne et al., Materials Science and Engineering A 459 (2007) 172-181 to compare the cooling rates of PFMS ribbons whose cooling rate were modified by laser heating. The relative cooling rates for the 24.9 m/s, 34.6 m/s, and 36.1 m/s projectile velocities are 2.71, 3.88, and 5.62 respectively, showing significant changes in the relative cooling rates within our investigated projectile velocities.

It should be noted that although the minimum average thickness of 6.06 μm was obtained at only a velocity of 36.1 m/s, we expect considerably thinner films with an increase in casting temperature, projectile velocity and projectile/melt contact angle which are the subject of on-going work. In fact, extrapolation of our current data (using simple data fitting models) for the effects of projectile velocity on dendrite arm spacings and film thickness, to projectile velocities around the speed of sound (340 m/s) results in dendrite arm spacings on the order of a nanometer and a film thickness of ~0.4 nm. More research is however needed to experimentally confirm these expectations.

CONCLUSIONS

A number of conclusions can be deduced from the present work.

Ballistic manufacturing has been successfully implemented for the first time to produce thick film of Sn-0.7Cu alloy.

A 2-D hypo-eutectic microstructure was obtained at all speeds investigated.

Increase in projectile velocity was found to decrease both dendrite arm spacing and thickness, with the lowest dendrite arm spacing being 70 μm and a film thickness of 6.06 μm at the maximum investigated velocity of 36.1 m/s.

Although described specifically throughout the entirety of the instant disclosure, representative embodiments have utility over a wide range of applications, and the above discussion is not intended and should not be construed to be limiting, but is offered as an illustrative discussion of aspects of the disclosure, What has been described and illustrated herein are embodiments of the disclosure along with some of their variations. The terms, descriptions and figures used herein are set forth by way of illustration only and are not meant as limitations. Those skilled in the art will recognize that many variations are possible within the spirit and scope of the disclosure, wherein the disclosure is intended to be defined by the following claims and their equivalents in which all terms are mean in their broadest reasonable sense unless otherwise indicated.

What is claimed is:

1. A method of applying a material to an article, the method comprising:

flowing a stream comprising a material in a first direction;

passing an article through the stream such that the material is applied to at least a portion of the article, wherein the article travels in a second direction at a speed of at least 1 m/s when passing through the flowing material; and separating at least a portion of the article from the material applied to the article, wherein the article is rotating while passing through the flowing material.

2. The method of claim 1, wherein separating at least a portion of the article comprising melting, dissolving, degrading, or volatilizing at least a portion of the article.

3. The method of claim 1, wherein the article is a composite comprising a first material and a second material, and wherein separating at least a portion of the article comprises removing the first material while the second material remains.

4. The method of claim 1, wherein a surface of the article comprises a feature with at least one dimension less than 100 nm.

5. The method of claim 1, wherein the article rotates about an axis that is parallel to the first direction.

6. The method of claim 1, wherein the article rotates about an axis that is perpendicular to the first direction.

7. The method of claim 1, wherein the article rotates about an axis that is parallel to the second direction.

8. The method of claim 1, wherein the article rotates about an axis that is perpendicular to the second direction.

9. A method of applying a material to an article, the method comprising:

flowing a stream comprising a material in a first direction, and passing an article through the stream such that the material is applied to at least a portion of the article, wherein the article travels in a second direction at a speed of at least 1 m/s when passing through the flowing material, wherein the article comprises a patterned mask on the surface of the article, wherein the material is selectively applied to exposed portions of the article uncovered by the mask, wherein the mask is a photolithographic mask, and wherein the article is rotating while passing through the flowing material.

10. The method of claim 9; wherein the article comprises a beveled edge.

11. The method of claim 10, where the beveled edge has an angle of at least 5°.

12. The method of claim 10, where the beveled edge has an angle of at least 10°.

13. The method of claim 10, where the beveled edge has an angle of at least 25°.

14. The method of claim 10, wherein the beveled edge has an angle of no more than 60°.

15. The method of claim 10, wherein the beveled edge has an angle of no more than 45°.

16. The method of claim 10, wherein the beveled edge has an angle of no more than 30°.

17. The method of claim 9, wherein the article rotates about an axis that is:

perpendicular to the first direction;

parallel to the second direction; or perpendicular to the second direction.

18. A method of applying a material to an article, the method comprising:

flowing a stream comprising a material in a first direction, passing an article through the stream such that the material is applied to at least a portion of the article, wherein the article travels in a second direction at a speed of at least 1 m/s when passing through the flowing material, and applying a decelerating force to the article after the article passes through the flowing material, wherein applying the decelerating force comprises applying a fluid pressure to the article, and wherein the article is rotating while passing through the flowing material.

19. The method of claim 18, wherein the article comprises one or more cavities, and wherein the material enters the one or more cavities when the article passes through the flowing material.

20. The method of claim 19, the method further comprising solidifying the material and separating the solidified material from the cavity, wherein the shape of the solidified material corresponds to the shape of the cavity.

21. The method of claim 19, the method further comprising solidifying the material and not separating the solidified material from the cavity.

22. The method of claim 18, wherein the article rotates about an axis that is:

perpendicular to the first direction;

parallel to the second direction; or perpendicular to the second direction.

* * * * *